United States Patent [19]

Rosenthal et al.

[11] 4,269,124

[45] May 26, 1981

[54] MERCHANDISE DISPLAY RACK

[75] Inventors: Stanley H. Rosenthal, Rt. 2, Box 713, Air Harbor Rd., Greensboro, N.C. 27405; George A. Poteat, Greensboro, N.C.

[73] Assignee: Stanley H. Rosenthal, Greensboro, N.C.

[21] Appl. No.: 81,011

[22] Filed: Oct. 1, 1979

[51] Int. Cl.[3] ..... A47B 49/00

[52] U.S. Cl. ..... 108/103; 211/163

[58] Field of Search ..... 108/103, 101, 94, 91; 211/163, 131

[56] References Cited

U.S. PATENT DOCUMENTS

| | | | |
|---|---|---|---|
| 317,175 | 5/1885 | Nauerth | 108/103 |
| 825,783 | 7/1906 | Wamble | 108/103 |
| 860,658 | 7/1907 | Hawthorne et al. . | |
| 887,715 | 5/1908 | Xander | 108/94 |
| 2,748,954 | 6/1956 | Murren | 108/91 |
| 2,972,415 | 2/1961 | Rensch | 108/103 |
| 2,973,867 | 3/1961 | Cohen . | |
| 3,255,890 | 6/1966 | Gerber . | |
| 3,478,890 | 11/1969 | Allsop . | |
| 3,526,443 | 9/1970 | Smith . | |
| 3,715,815 | 2/1973 | Lewis | 108/94 |
| 3,844,230 | 10/1974 | Hudson et al. | 108/103 |
| 4,030,608 | 6/1977 | Howard | 108/94 |
| 4,036,367 | 7/1977 | Stambaugh et al. . | |
| 4,126,366 | 11/1978 | Handler et al. | 211/163 |

FOREIGN PATENT DOCUMENTS

| | | | |
|---|---|---|---|
| 1417963 | 12/1975 | United Kingdom | 211/131 |

*Primary Examiner*—Francis K. Zugel

*Attorney, Agent, or Firm*—William S. Burden

[57] ABSTRACT

A decorative merchandise display rack includes a support structure rotatable about a vertical axis and having a plurality of disk-like transparent shelves maintained in spaced, super-posed relation by a series of discrete, stacked, mirrored spacer units, each having pins for coupling the shelves and opposed end portions of adjacent spacer units for rotation as a unit. Opposed cup-shaped members are provided at opposite ends of the support structure and receive the ends of a series of vertically oriented transparent rods which extend through aligned openings provided adjacent the outer peripheral portions of the shelves.

8 Claims, 4 Drawing Figures

MERCHANDISE DISPLAY RACK

BRIEF SUMMARY AND OBJECTS OF THE INVENTION

This invention relates generally to a merchandise display assembly, and more particularly to a type in which a plurality of selectively spaced shelves having articles, such as shoes, mounted thereon for display can be brought into position to provide maximum accessibility to the merchandise.

Briefly, the display assembly is constructed of materials which are aesthetically pleasing while at the same time presents all merchandise on the display where it can be readily, conveniently and artistically presented to a customer. In the preferred embodiment, a number of components are of clear or transparent plastic construction, while other components have been provided with mirrored surfaces to better display and direct attention to the merchandise.

More particularly, the invention contemplates the use of a plurality of discrete, substantially identical spacer units capable of being readily stacked in interlocked, superposed relation with disk-like shelves being positioned intermediate and supported by selected, adjacent spacer units. A series of vertically extending rods extend through the shelves, with opposite ends being received within opposed cup-shaped housings.

One of the primary objects of the invention is the provision of a new and improved merchandise display rack which conveniently and attractively displays a large number of shoes.

Another object of the invention is the provision of a display rack for supporting a large number of shoes in a minimum area.

A further object of the invention is the provision of a display assembly which is adapted to be readily and conveniently assembled with shelves selectively spaced.

Still another object of the invention is the provision of an improved rotatable display of relatively simple construction which will attractively present the merchandise carried thereon to a customer.

Other objects and advantages of the invention will become apparent when considered in view of the following detailed description.

DETAILED DESCRIPTION OF THE INVENTION

Figure 1:
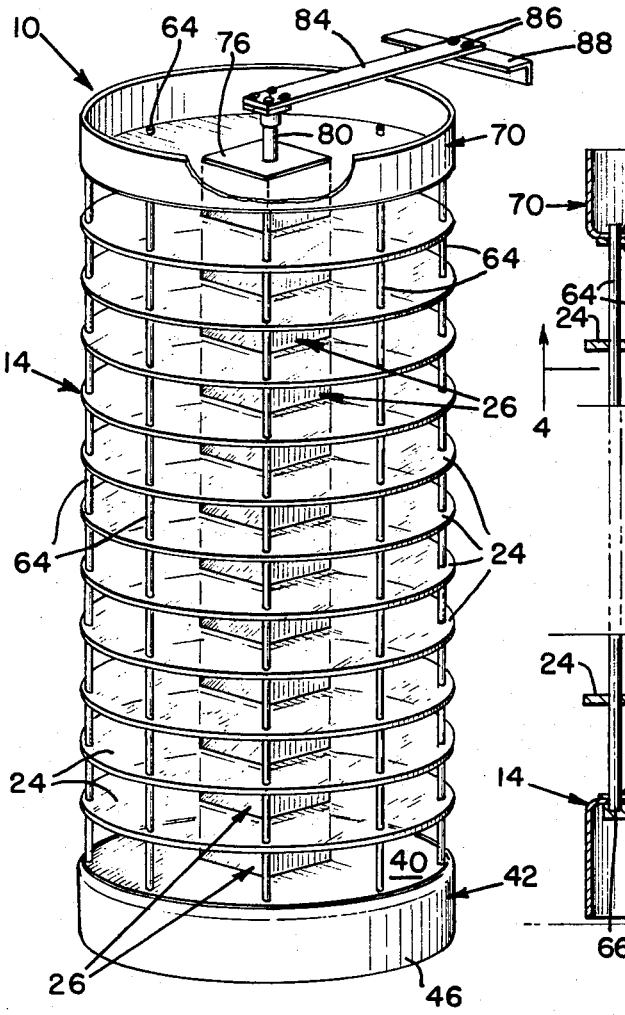
FIG. 1 is a schematic, perspective view of the display rack of the present invention.

Referring to the drawing and initially to FIG. 1, the display rack 10 includes a base strcture 12 adapted to rest upon a floor or other support surface, and a vertically disposed merchandise support assembly 14 mounted upon the base structure for rotation relative thereto.

The base 12 includes a platform member 16 having a bearing unit 18 secured thereto by suitable fasteners 20. The bearing unit 18 preferably is of a ball bearing type and rotatably receives a portion of a stub shaft 22 of the rotatable support assembly 14.

The assembly 14 includes a plurality of article supporting shelves 24 maintained in spaced, superposed relation by a series of spacer units 26. In a preferred embodiment, the shelves 24 are relatively thin disk-like members, preferably of Plexiglas synthetic resin material. Each shelf 24 is provided with a central opening 27, a series of spaced openings 28 adjacent the outer peripheral edge, and a series of openings 30 spaced radially outwardly of the central opening 27.

Figure 3:
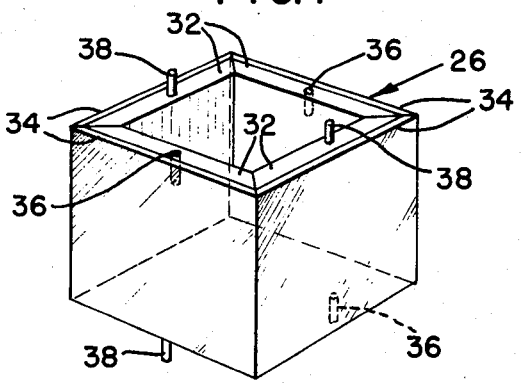
FIG. 3 is a perspective view of one of the spacer units of FIG. 2.
Figure 4:
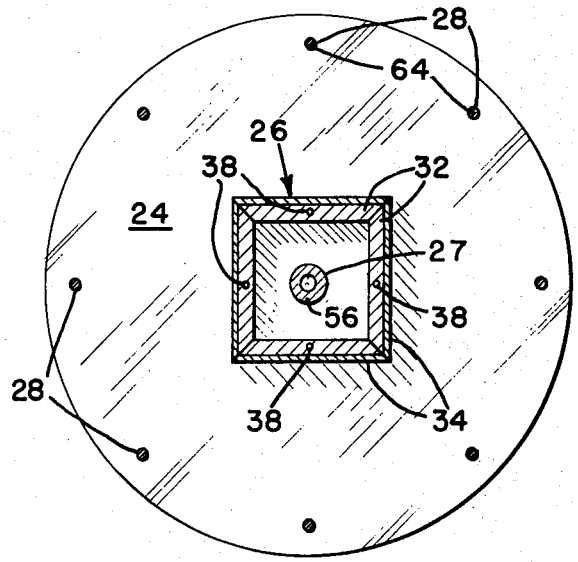
FIG. 4 is a view of a shelf unit and spacer unit, and taken along line 4—4 of FIG. 2.

Each spacer unit 26, see FIG. 3, includes four wall sections 32 secured together in a suitable manner to define a box-like structure having open ends. The outer surfaces of the wall sections 32 are encompassed by suitable mirrors 34. The four mirror sections 34 preferably are mitered, as shown by FIG. 3, and may be of Plexiglas synthetic resin construction laminated to the wall sections 32.

Each wall section 32 may be of plywood construction and provided with opposed recesses 36 therein approximately mid-way of the length of each end portion, as shown by FIG. 3, for receiving dowel pins 38. Two dowel pins 38 are received within recesses 36 at each end of a spacer unit 26, with two pins 38 at one end being secured within opposed wall sections 32 while the two pins at the opposite end of the unit 26 are secured within recesses 36 of the other two wall sections 32. The dowel pins 38 projecting from the end of one spacer unit 26 extend through openings 30 in a shelf 24 and into aligned recesses 36 in an adjacent spacer unit 26. Therefore, the pins serve to lock the shelves for rotation with the spacer units. While the drawing illustrates a shelf 24 positioned intermediate each pair of adjacent spacer units 26, it is to be understood that two or more spacer units may be stacked in superposed relation and interlocked by dowel pins 38 intermediate shelves 24.

The lowermost spacer unit 26 rests upon a mirror 40 which is secured to a downwardly opening, generally cup-shaped member 42 having a disc portion 44 and an integral depending skirt portion 46. The mirror 40 has a diameter generally corresponding to the diameter of a shelf 24 and is provided with a central opening 48 and a series of openings 50 spaced adjacent the outer peripheral portion of the disk 44.

The lower peripheral edge 52 of the skirt portion 46 is in close proximity to but spaced above a floor or other support surface by the shaft 22, a support plate 54 and an elongated, generally vertically disposed tubular member 56. A portion of the shaft 22 is received within a central bore of the tubular member 56 and is fixedly secured thereto by welding. Fasteners 58 extend through a metal plate 60, support plate 54, the cup-shaped member 44, mirror 40 and are threadably received within the tubular member 56. Fasteners 62 also serve to secure the metal plate 60 to the support plate 54. Since the lower end portion of shaft 22 is rotatably supported in bearing unit 18, the entire article support assembly is mounted for rotation about a generally vertical axis.

Clear plastic rods 64 extend through openings 28 of the shelves, and the lower end portions are received within recesses 66 provided in the support plate 54. The upper ends of the rods 64 pass through openings 68 provided in an upwardly opening cuplike member 70, and openings 72 within a mirror 74 which is substantially identical to mirror 40. Mirrors 40 and 74 preferably are cemented to their respective support members. The dowel pins 38 of the uppermost spacer unit 26 pass through openings in the mirror 74 and cup-like member 70 and into recesses of a support plate 76.

The support plate 76 has a central opening 78 for receiving therethrough a shaft 80 which extends into and is suitably secured to the tubular member 56. The opposite end of the shaft 80 is received within a bearing 82, which may be of the same type as bearing 18. Bearing 82, which provides stability for the display assembly, is mounted upon an elongated, generally horizontally disposed support member 84 having an end portion attached by fastener 86 to a bracket 88 which, in turn, is secured to a support surface in a suitable manner.

Figure 2:
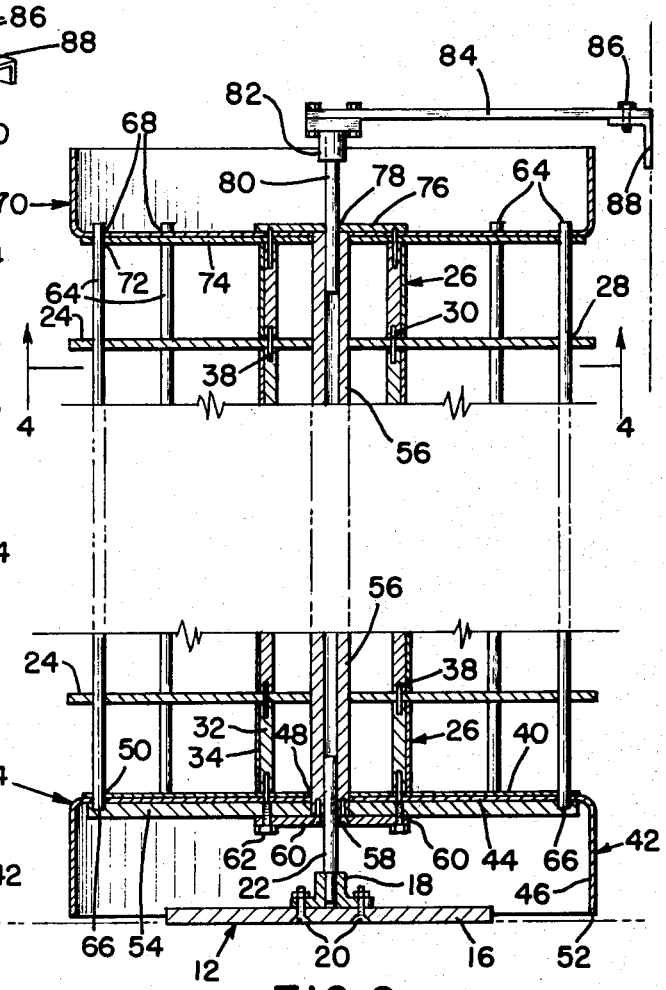
FIG. 2 is an enlarged, fragmentary side elevational view of display rack partly in section illustrating the various components thereof.

In assembling the apparatus, the elongated tubular member 56, metal plate 60, support plate 54 and shaft 22, all of which are secured together, are supported upon the base 12. A first spacer unit 26 provided with dowel pins 38 at the lower end is positioned upon the mirror 40 with the pins extending through aligned openings in the mirror, cup-shaped member 42 and into recesses in plate 54. The upper end of the first spacer unit has two dowel pins 38 secured thereto which project upwardly and may be received directly within recesses 36 provided in a second, superposed spacer unit 26, or a shelf 24 may be mounted upon the upper end of the first spacer unit, as shown by FIG. 2, with the upwardly extending pins 38 passing through shelf openings 30, prior to mounting a second spacer unit 26. When the second spacer unit 26 is properly positioned, two pins 38 projecting from the lower end thereof extend into recesses 36 in the upper end of the first spacer unit while recesses in the lower end of the second spacer unit receive the projecting pins 38 of the first unit. Spacer units and shelves may be selectively positioned in the manner previously described until a display assembly of the desired height and having a prescribed number of selectively spaced shelves has been assembled. This construction permits rapid and convenient assembly and/or disassembly of various size display racks. The spacer units and shelves are lifted over the upper end of tubular member 56. Once the spacer units and shelves havebeen selectively positioned, the clear plstic rods 64 are displaced vertically downwardly through the aligned openings 28 in the shelves 24 until the lowermost ends rest within recesses 66 of the support plate 4. The cup-shaped member 70 then is positioned over the upper ends of the rods 64 and the projecting pins 38 of the top spacer unit 26.

While the shelves 24, rods 64 and spacer units 26 may be formed of various materials, in the preferred embodiment, the rods and shelves are of Plexiglas resin construction. The mirrors 34, 40 and 74 also may be Plexiglas resin. The cup-shaped members 42,70 also preferably are of vacuum formed plastic materials.

With the various elements arranged as disclosed, the entire support assembly 14 can be conveniently manually rotated by grasping a rod 64 or shelf 24 so that merchandise upon the shelves is advantageously brought into full view of the customer, thereby providing maximum accessibility to all merchandise. If desired, the display may be provided with a motor for rotating the assembly 14.

It is to be understood that the shelves, spacer units, etc., may be of any suitable materials with different types, sizes and quantities of shelves and spacer units being utilized, as desired

What is claimed is:

1. In a display apparatus, vertically disposed support means, base means mounting said support means for rotation relative thereto, said support means including an elongated, vertically disposed column mounted for rotation upon said base means, said support means further including a plurality of vertically spaced, relatively thin, disk-like shelves, each defining a central opening therethrough for receiving said vertical column and a plurality of secondary openings therethrough equally spaced radially outwardly of said central opening, and spacer means surrounding said vertical column in spaced relation thereto and supporting said shelves in spaced relation, said spacer means including a plurality of discrete spacer units, each spacer unit including pin means projecting therefrom in opposite directions for extending through adjacent shelf secondary openings and for interlocking with adjacent spacer units, each spacer unit further including recesses therein for lockingly receiving projecting pins of adjacent spacer units, each said disk-like shelf further defining a series of openings spaced radially outwardly of said secondary, pin receiving openings adjacent the shelf outer periphery, and rod-like members extending vertically through said series of openings.

2. In a display apparatus as recited in Claim 1, wherein said plurality of shelves are constructed of transparent materials, and wherein each of said spacer units are provided with mirrors on the outer peripheral surfaces thereof.

3. In a display apparatus as recited in claim 1, and further including bearing means for stabilizing the uppermost end portion of said vertically disposed column.

4. In a display apparatus as recited in claim 4, said vertically disposed support means including shaft means projecting axially outwardly of and secured to said vertically disposed column, said base means including bearing means for receiving said shaft means, said vertically disposed support means further including a support plate secured to an end portion of said column, and a downwardly opening cup-shaped member having a disk portion supported by said support plate and an integral skirt portion depending from said disk portion, said cup-shaped member being provided with openings for receiving the projecting pins of an adjacent spacer unit.

5. In a display apparatus as cited in claim 4, and further including an upwardly opening cup-shaped member supported by the uppermost shelf of said plurality of shelves, and further including bearing assembly means for stabilizing the uppermost end portion of said vertically disposed column.

6. In a merchandise display rack having an article supporting assembly rotatable about a generally vertically extending axis and supported upon a base assembly, said article supporting assembly including a rotatable support column, a plate member secured to the support column adjacent the lower end thereof, said plate member supporting a plurality of discrete, box-like spacer units in superposed relation with said spacer units encompassing and in spaced relation to said support columm, each of said spacer units including oppositely projecting pins and defining pin receiving recesses for releasably intercoupling adjacent spacer units to each other, said plate member defining recesses therein for receiving the projecting pairs of said lowermost spacer unit of said plurality of spacer units for coupling said spacer units for rotation with said rotatable column support, said article supporting assembly further including a plurality of disk-like shelf units, each said shelf unit defining first and second series of openings therein, said shelf units being supported intermediate selected adjacent spacer units and releasably secured thereto by said projecting pins extending through said series of openings, said article supporting assembly including means secured to and projecting axially of said support column for resting upon said base assembly and maintaining said plate member in spaced relation above said base assembly, and further including a series of vertically disposed posts spaced radially outwardly of said spacer units and extending through said second series of openings of said disk-like shelf units.

7. In a merchandise display rack as recited in claim 6, said plurality of spacer units and said plurality of shelf units being alternately positioned in spaced vertical arrangement.

8. In a merchandise display rack as recited in claim 6, said spacer units including mirrors positioned intermediate said plurality of shelves, and said plurality of shelves being constructed of transparent material.

* * * * *